United States Patent [19]

Kakizaki et al.

[11] 4,311,129

[45] Jan. 19, 1982

[54] AUXILIARY AIR REGULATOR FOR INTERNAL COMBUSTION ENGINE

[75] Inventors: Tadao Kakizaki, Isezaki; Akira Utsugi, Fujimi; Masahiro Hibino, Tokyo; Kizuku Otsubo, Kawasaki, all of Japan

[73] Assignees: Nissan Motor Co. Limited, Yokohama; Japan Electronic Control Systems Co. Ltd., Isezaki, both of Japan

[21] Appl. No.: 72,435

[22] Filed: Sep. 4, 1979

[30] Foreign Application Priority Data

Oct. 23, 1978 [JP] Japan ..... 53-130303

[51] Int. Cl.[3] ..... F02M 23/10

[52] U.S. Cl. ..... 123/588; 123/179 G; 251/11; 261/39 B

[58] Field of Search ..... 123/588, 585, 179 G; 251/11; 261/39 B, 39 E

[56] References Cited

U.S. PATENT DOCUMENTS

| | | | |
|---|---|---|---|
| 1,841,386 | 1/1932 | Starr | 123/588 |
| 2,083,650 | 6/1937 | Hilton | 123/588 |
| 3,000,394 | 9/1961 | Gold et al. | 123/585 |
| 3,259,377 | 7/1966 | Braun et al. | 261/39 B |
| 3,618,890 | 11/1971 | Bastam | 123/585 |
| 3,947,531 | 3/1976 | Branigin | 261/39 B |
| 3,996,909 | 12/1976 | Fischer | 123/585 |
| 4,187,821 | 2/1980 | Zebli | 123/588 |
| 4,197,823 | 4/1980 | Schwartz et al. | 123/588 |

*Primary Examiner*—Charles J. Myhre
*Assistant Examiner*—Andrew M. Dolinar
*Attorney, Agent, or Firm*—Schwartz, Jeffery, Schwaab, Mack, Blumenthal & Koch

[57] ABSTRACT

In an internal combustion engine having an air intake passage containing a throttle valve, and provided with passages to the outside from points upstream and downstream of the throttle valve, an auxiliary air regulator comprising a mounting block within which is formed a bypass passage, one end of which is matably connected with a passage in said air intake passage upstream of the throttle valve, and the other end of which is matably connected with a passage in said air intake passage downstream of the throttle valve. A movable shutter means is disposed within said bypass passage so as to control the effective cross-sectional area of said bypass passage. A bimetallic coil is enclosed within an air tight chamber annd being selectively heated. Engaging means connects the outer end of said bimetallic coil with said shutter means so that a movement of the bimetallic coil in response to a temperature change is transmitted mechanically to the shutter means. The auxiliary air regulator is directly attached to the air intake passage.

4 Claims, 9 Drawing Figures

AUXILIARY AIR REGULATOR FOR INTERNAL COMBUSTION ENGINE

BACKGROUND OF THE INVENTION

This invention relates to a gas flow control device, and more particularly to an auxiliary air regulator suitable for use with an internal combustion engine and provided in a bypass passage detouring a throttle valve in an air intake passage in order to provide a suitable amount of air required for the startup of the engine when it is cold.

Generally, when an internal combustion engine is started under cold conditions, the combustion conditions are suboptimal, and friction losses increase, thereby increasing the load on the engine. Accordingly, it is necessary to increase the amount of air intake to the engine, as compared with the amount under normal, warm, running conditions.

Thus, in an engine with a fuel injection device, an auxiliary air regulator, which has a control valve that opens depending on temperature, has conventionally been provided in a bypass passage detouring a throttle valve in the intake air passage in order to increase the amount of air flow when the engine is cold and simultaneously to provide an auxiliary supply to the engine. In this way, starting of the engine from cold is improved.

The amount of auxiliary air required decreases as the warming-up of the engine proceeds, as shown in FIG. 1 of the accompany drawings, and therefore the auxiliary air regulator is designed to decrease the auxiliary amount of air supplied with time. First, two examples of prior art auxiliary-air regulators will be described in more detail with respect to the drawings. FIG. 2 of the drawings shows a cross-sectional view of a first prior art control device. A shutter means 1 has a shutter plate 1*a* provided in a bypass air passage 2 and pivotally supported by a pin 4 mounted in the wall of passage 2. The shutter plate 1*a* is engaged at one end with the end of a bimetallic strip 3 disposed within a bimetallic strip chamber 5 adjacent to the bypass air passage 2, whereby the shutter plate 1*a* rotates about pin 4 according to the displacement of bimetallic strip 3 to open and close the bypass passage. However, this device has necessarily a small clearance around the shutter plate in the vicinity of its pivoted point, which forms a communicating passage between the air flow passage 2 and bimetallic strip chamber 5. Thus, it is impossible to completely prevent leakage of air from the bimetallic strip chamber 5. The air pressure within air passage 2 is very low because of the effect of the engine intake on the downstream side of air passage 2 so that air leaks from the bimetallic strip chamber 5 to the air passage 2. Since this air leakage tends to cool bimetallic strip 3 and heat is radiated through the metallic wall of the bimetallic strip chamber 5, heating of bimetallic strip 3 by a heater 6 during warming-up of the engine is hindered. This deleterious effect is especially large when the ambient air temperature is low, which slows down the displacement of the bimetallic strip 3 thereby failing to displace the same to its correct predetermined position. This lowers the speed with which the shutter is closed and supplied the engine with more air than is required for the warming-up period. Further, the shutter is not completely closed by the time that the warming-up of the engine has been completed with the result that the engine continues to rotate at a speed higher than its correct predetermined value.

In order not to hinder the movement of the bimetallic strip 3, the heater 6 should be mounted only on a part of the bimetallic strip 3, which makes temperature control of the bimetallic strip difficult and induces errors in the displacement of the bimetallic strip, and therefore makes for unstable control of the engine.

A second prior art device, illustrated in FIG. 4, is disclosed in U.S. Pat. No. 3,618,890 to Hans-Dieter Bastam. This device has a cup-shaped member 10 of insulating material in a housing 11, a heater 12 on the bottom of the cup-shaped member, and a bimetallic coil 13 disposed above the heater. The bimetallic coil has at its center a vertically projecting stem 14 at the top of which is mounted a hollow cylindrical valve member 15. This valve member has an opening 15*a* in its side wall and a top opening 15*b* and is rotatably received in a valve seat 16 which has an outlet opening which registers with the top opening of the valve member, and an inlet opening which selectively registers with the opening in the side wall of the valve member, according to the rotational position of the valve member. Reference numeral 17 denotes an electric energy supply cable. This device tends to perform slow control of the amount of air supplied to the engine during the startup period because the stem of the valve member is mounted at the central, or inner, end of the bimetallic coil where the displacement is smaller than at the outer end of the bimetallic coil.

Both prior art devices are of the separate type. The first is adapted to be mounted as shown in FIG. 3 wherein reference numeral 20 denotes the auxiliary air regulator, reference numeral 21 a throttle chamber, reference numerals 23, 24 rubber hoses, reference numeral 25 an air cleaner, reference numeral 26 an air flow meter, reference numeral 27 a throttle valve, reference numeral 28 a cold start valve, reference numeral 29 a fuel injector, reference numeral 30 intake air valve, reference numeral 31 an ignition plug, and reference numeral 32 a piston.

The second prior art device is adapted to be mounted on a flange or chassis 18 of a motor vehicle, as shown in FIG. 4. These devices use rubber hoses and clamps or other connecting means to connect their inlets and outlets to points in the throttle chamber upstream and downstream respectively of the throttle. The use of such hoses and clamps increases manufacturing costs, is more inconvenient from the point of view of the arrangement of other components, and increases the number of joints thereby lowering the reliability of airtightness.

SUMMARY OF THE INVENTION

It is therefore an object of the present invention to provide an auxiliary air regulator of the above type which eliminates the drawbacks mentioned above.

It is another object of the present invention to provide an auxiliary air regulator of the above type which decreases the amount of auxiliary air supplied to the engine relatively quickly during the warming-up period of the engine.

A further object of the present invention is to provide an auxiliary air regulator of the above type which is constructed integrally with a throttle chamber thereby to provide a compact structure and reduced manufacturing costs.

According to the present invention, there is provided, in an internal combustion engine having an air intake passage containing a throttle valve, and provided with passages to the outside from points upstream and downstream of the throttle valve, an auxiliary air regulator comprising:

(a) a mounting block within which is formed a bypass passage, one end of which is matingly connected with a passage in said air intake passage upstream of the throttle valve, and the other end of which is matably connected with a passage in said air intake passage downstream of the throttle valve, (b) a movable shutter means disposed within said bypass passage so as to control the effective cross-sectional area of said bypass passage;

(c) an airtight chamber airtightly separated from said bypass passage;

(d) a bimetallic coil enclosed within said chamber and having its central end fixedly attached to said chamber;

(e) engaging means engaging the outer end of said bimetallic coil with said shutter means so that a movement of the bimetallic coil in response to a temperature change is transmitted mechanically to the shutter means; and (f) a heater means disposed within the chamber and capable of selectively heating the bimetallic coil;

the auxiliary air regulator being directly attached to the air intake passage.

Other objects and features of the present invention will become clear from the following detailed description of a preferred embodiment with reference to the accompanying drawings.

BRIEF DESCRIPTION OF THE DRAWINGS

Throughout the drawings, the same reference numeral denotes similar parts and components of the device.

In the drawings.

DESCRIPTION OF THE PREFERRED EMBODIMENT

Figure 5:
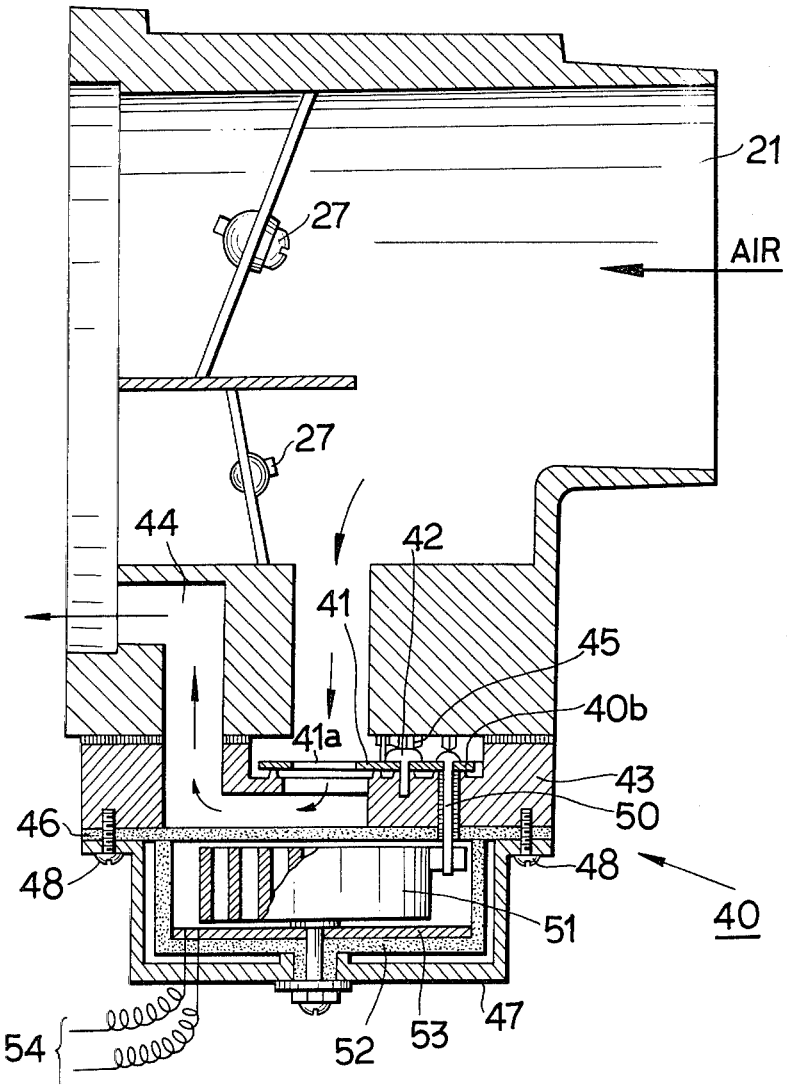
FIG. 5 shows a cross-sectional view of an auxiliary air regulator according to the present invention.

Referring to FIG. 5, there is shown a preferred embodiment of an auxiliary air regulator, generally denoted at 40, according to the present invention. A shutter means 41, which may for example be a metallic plate with a coating of an emulsified fluorocarbon polymer such as Teflon (trademark of the Du Pont Corporation) thereon, is mounted so as to be rotatable about a fixing pin 42 which is secured to a shutter mounting block 43 and within an air bypass passage 45, detouring throttle valves 27 in a throttle valve chamber 21. The shutter plate 41 is biased by a return spring 44 towards the position where the bypass passage is opened to its maximum. The bypass passage 44 is defined by the side wall of the throttle valve chamber 21, the shutter mounting block 43, and a heat insulating wall 46.

Figure 6:
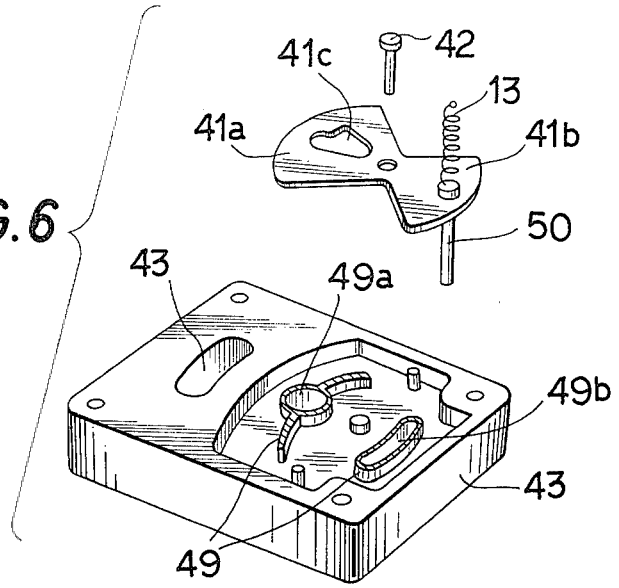
FIG. 6 shows an enlarged perspective view of a shutter means and a shutter mount of the FIG. 5 device.

The shutter mounting block 43 may for example be fixed by adhesive to the wall of the throttle valve chamber 21. The heat insulating wall 46 forms one wall of a bimetallic coil chamber 47 and may be fixed to the underside of the shutter mounting block by suitable screws 48. The shutter plate slides in an airtight manner on a shutter seat formed from projections on the shutter mounting block 43. In FIG. 6, the configuration of shutter means 41 and shutter seat 49 are clearly illustrated. Shutter means 41 has a main shutter plate portion **41*a* provided at a position where the portion 41*a* can close an opening 49*a* in the shutter seat 49. Thus, the amount of air passing through opening 49*a* is controlled by the extent to which the opening 49*a* and a shutter opening 41*c* provided in the main shutter plate portion 41*a*** coincide.

Figure 7:
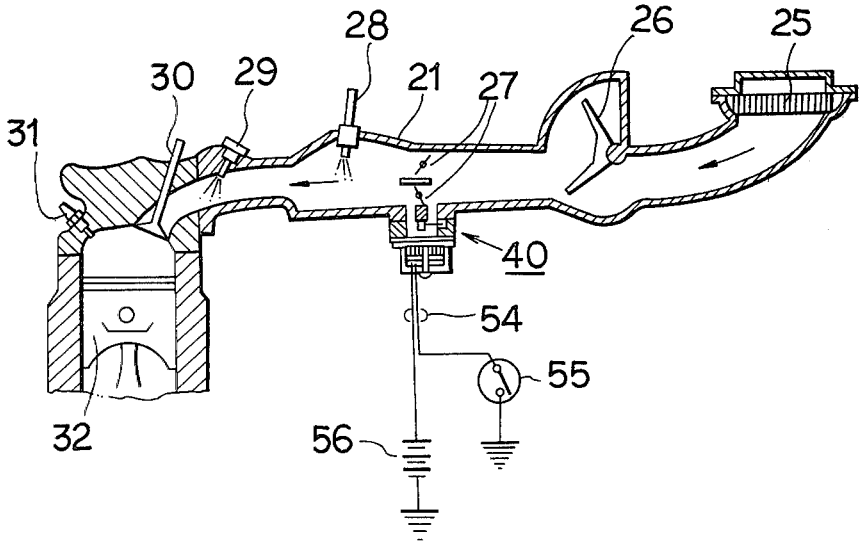
FIG. 7 shows a cross-sectional view of an intake air system incorporating the FIG. 5 device according to the present invention.

Shutter means 41 has a subsidiary shutter plate portion **41*b* which is placed so as to close an arcuate slot 49*b* formed within one rib of the shutter seat 49 on the shutter mounting block 43. The subsidiary plate portion 41*b* is provided with a connecting rod 50 which extends through slot 49*b* and connects with the outer end of a bimetallic coil 51 within the bimetallic coil chamber 47. Shutter means 41 can be rotated by connecting rod 50, according to the displacement of the bimetallic coil 51 through an arc about the fixing pin 42, without contacting the side wall of slot 49*b*. Thus, slot 49*b*, which is a passage for connecting rod 50, is at all times airtightly closed by the portion 41*b*, thereby preventing the leakage of air from the bimetallic coil chamber which was a drawback of prior art devices. Bimetallic coil 51 is surrounded by a chamber 47, of which part of the wall is made up by the insulating wall 46, and the rest by a heat insulating wall 52. The heat insulating walls 46 and 52 may be formed of, for example, asbestos and glass wool to prevent cooling of bimetallic coil 51 by the atmosphere and to improve airtightness, thus, to enable exact control of the temperature of the bimetallic coil. Bimetallic coil 51 is heated by a disc-shaped heater 53 provided below it and selectively supplied with electric power through wires 54 and a switch 55 from a source of power 56, as shown in FIG. 7**.

Figure 1:
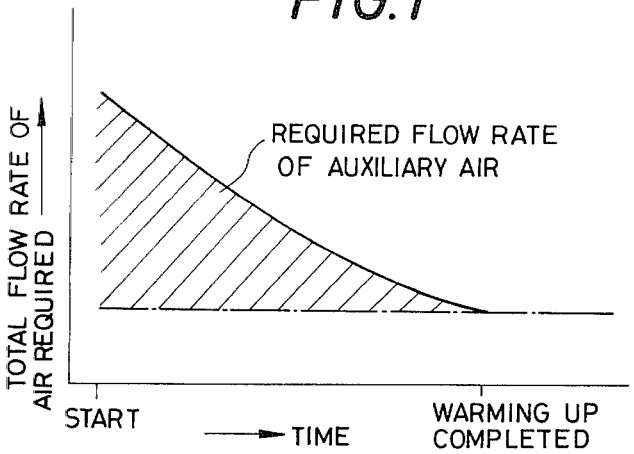
FIG. 1 is a graph of the amount of auxiliary air required against time for the start-up and warmingup period of the internal combustion engine.
Figure 2:
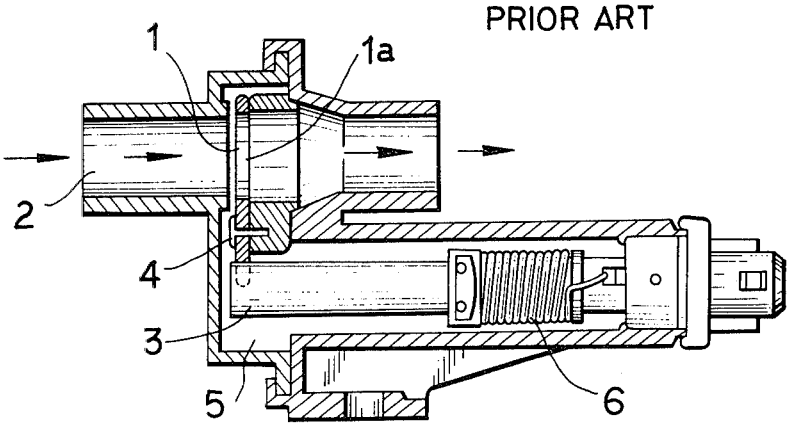
FIG. 2 PRIOR ART
FIG. 2 shows a cross-sectional view of a first prior art auxiliary air regulator.
Figure 3:
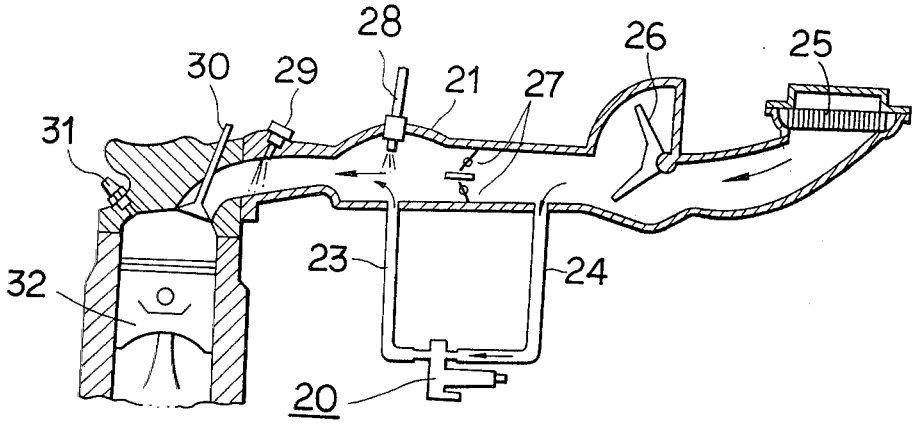
FIG. 3 PRIOR ART
FIG. 3 shows a cross-sectional view of an intake air system incorporating the FIG. 2 device.
Figure 4:
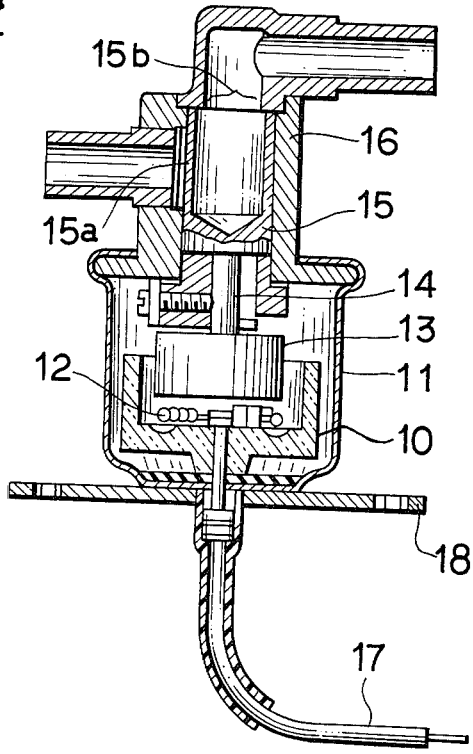
FIG. 4 PRIOR ART
FIG. 4 shows a cross-sectional view of a second prior art auxiliary air regulator.
Figure 8:
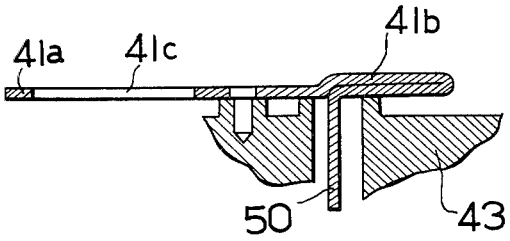
FIG. 8 shows a cross-sectional view of a modification of the shutter means.
Figure 9:
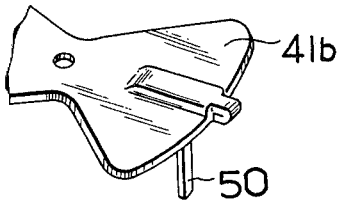
FIG. 9 shows a fragmentary view of the modification of FIG. 8.

According to the auxiliary air regulator of the present invention, the amount of intake air during the start-up of the engine is more precisely controlled with time depending on the temperature of the atmosphere because the connecting rod for the shutter plate is connected with the outer end of the bimetallic coil. Further, as shown in FIG. 7, the regulator 40 is directly attached to the side of the throttle valve chamber so that rubber hoses, clamps, and so forth used with prior art devices such as shown in FIG. 3 are unnecessary, thereby providing an auxiliary air regulator of compact structure. In order to connect shutter means 41 and bimetallic coil 51 in airtight manner, a connecting rod 50 has been used in the embodiment illustrated, but for the same purpose, a connecting link 50 may be formed by bending a part of the subsidiary shutter plate portion **41*b* as shown in FIGS. 8 and 9. Alternatively, the FIG. 5 embodiment may be modified such that the subsidiary shutter plate portion 41***b* and the slot 49*b* are omitted and that the pivotal pin passes through the partition 46 between air passage 44 and bimetallic coil chamber 47 and is directly connected by an arm member to the bimetallic coil so as to open and close the shutter means.

While the present invention has been illustrated and described with reference to a preferred embodiment thereof, it is not intended to be limited to the details shown, since various changes and omissions in such details will be clear to those skilled in the art.

What is claimed is:

1. An auxiliary air regulator for use in an internal combustion engine having an air intake passage containing a throttle valve and provided with passages to the outside from points upstream and downstream of the throttle valve, comprising:

a mounting block within which is formed a bypass passage, one end of which is matingly connected with a passage in said air intake passage upstream of the throttle valve, and the other end of which is matingly connected with a passage in said air intake passage downstream of the throttle valve, said mounting block being directly attached to said air intake passage;

a shutter movably disposed within said bypass passage so as to control the effective cross-sectional area of said bypass passage, said shutter comprising a substantially flat plate having an aperture formed therein, said flat plate being pivotally connected to said mounting block;

a seat surrounding said bypass passage and formed by projections on said mounting block, in such a manner that said flat plate slides airtightly on said seat;

wall members defining a chamber airtightly separated from said bypass passage;

a bimetallic coil enclosed within said chamber and having its central end fixedly attached within said chamber;

means for engaging the outer end of said bimetallic coil with said shutter whereby movement of the bimetallic coil in response to a temperature change is transmitted mechanically to said shutter, said engaging means comprising a connecting rod member protruding from said shutter, a slot formed in said mounting block through which said connecting rod member passes, and a seat surrounding said slot and formed by projections on said mounting block in such a manner that said flat plate airtightly slides thereon; and a heater disposed within the chamber for selectively heating said bimetallic coil.

2. An auxiliary air regulator according to claim 1, wherein said connecting member comprises a bent portion of said flat plate.

3. An auxiliary air regulator according to claim 1, wherein said connecting rod member comprises a pin attached to said flat plate.

4. An auxiliary air regulator according to claim 1, 2 or 3, wherein at least a part of the wall members defining said chamber comprise a heat-insulating material.

* * * * *